United States Patent [19]

Nigra

[11] 4,137,889

[45] Feb. 6, 1979

[54] FUEL DIAPHRAGM PUMP WITH SHUT-OFF VALVE

[75] Inventor: Antonio Nigra, Nole Canavese (Turin), Italy

[73] Assignee: Gilardini S.p.A., Turin, Italy

[21] Appl. No.: 817,774

[22] Filed: Jul. 21, 1977

[30] Foreign Application Priority Data

Mar. 7, 1977 [IT] Italy ..... 67492 A/77

[51] Int. Cl.[2] ..... F02B 77/08

[52] U.S. Cl. ..... 123/198 DB; 137/38; 180/104

[58] Field of Search ..... 123/198 DB, 198 D; 137/38, 43; 180/104

[56] References Cited

U.S. PATENT DOCUMENTS

| | | | |
|---|---|---|---|
| 3,942,504 | 3/1976 | Ellsworth | 123/198 DB |
| 3,983,890 | 10/1976 | Rogers, Jr. | 123/198 DB X |
| 4,011,848 | 3/1977 | Coddington | 123/198 DB X |
| 4,041,967 | 8/1977 | Tsukisaka | 123/198 DB X |
| 4,054,116 | 10/1977 | Coddington | 123/198 DB |

*Primary Examiner*—Ira S. Lazarus

*Attorney, Agent, or Firm*—Ladas, Parry, Von Gehr, Goldsmith & Deschamps

[57] ABSTRACT

A diaphragm pump for feeding fuel to internal combustion engines is described. The pump comprises one inlet duct for fuel from a tank provided with an outlet duct, and an outlet duct for the fuel from the pump, and comprises a suction valve and a discharge valve operated by the diaphragm to transfer the fuel from the inlet duct to the outlet duct. The main feature of the pump is to comprise a shut-off valve completely separate from the suction and discharge valves and disposed in the path of the fuel between the inlet duct and outlet duct, said shut-off valve being open during normal operation of the pump, and closing to block the passage of the fuel when the motor vehicle on which the pump is mounted overturn.

6 Claims, 2 Drawing Figures

FUEL DIAPHRAGM PUMP WITH SHUT-OFF VALVE

BACKGROUND OF THE INVENTION

This invention relates to a diaphragm pump for feeding fuel to internal combustion engines, and provided with a shut-off valve which stops the outflow of fuel from the pump should the motor vehicle on which the pump is mounted overturn.

Mechanically operated diaphragm pumps are generally disposed between the vehicle tank and carburettor at a higher level than the tank. If the vehicle overturns, it is possible for the fuel to flow continuously from the pump as the pump is at a lower level than the tank, and this can lead to serious danger of fire and explosion.

SUMMARY OF THE INVENTION

The object of the present invention is therefore to provide a diaphragm pump for feeding fuel to endothermic engines which prevetns the fuel from flowing from the pump should the vehicle overturn, so obviating the aforesaid drawbacks and dangers, using a simple and economical construction.

According to the present invention there is provided a diaphragm pump for feeding fuel to endothermic engines, comprising at least one inlet duct for fuel from a tank provided with an outlet duct, and an outlet duct for the fuel from said pump, said pump also comprising a suction valve and a discharge valve operated by said diaphragm to transfer the fuel from said inlet duct to said outlet duct, and comprising a shut-off valve completely separate from said suction and discharge valves, and disposed in the path of said fuel between said inlet and outlet duct, said valve being open during normal operation of said pump to allow passage of the fuel, and said valve closing to block the passage of the fuel when said inlet duct of said pump is at a level, relative to said outlet duct from said tank, which is of opposite sign.

BRIEF DESCRIPTION OF THE DRAWINGS

The present invention will be more evident from the description given hereinafter by way of non-limiting example of one embodiment with reference to the accompanying drawings in which.

DETAILED DESCRIPTION OF THE INVENTION

Figure 1:
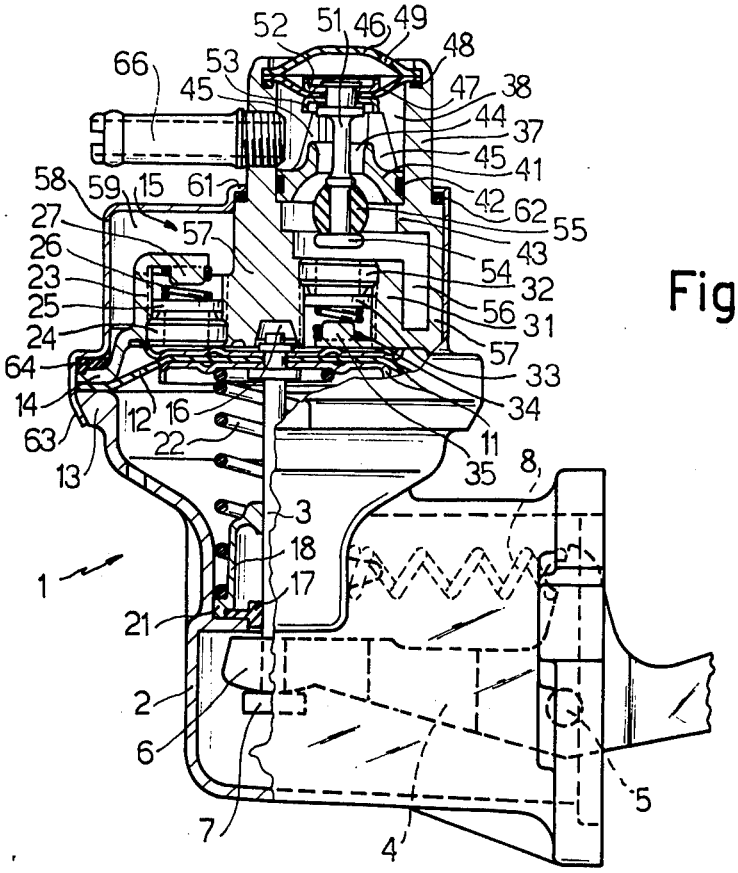
FIG. 1 is a partially sectional lateral view of the pump according to the present invention.
Figure 2:
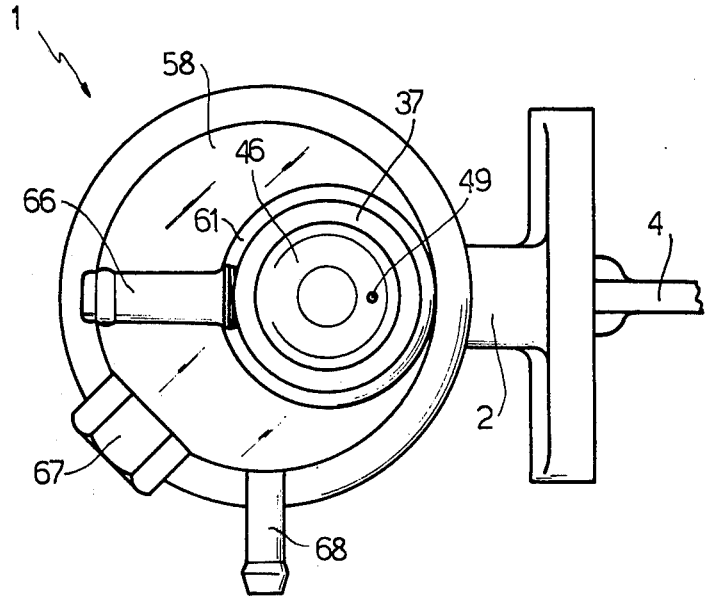
FIG. 2 is a plan view of the pump of FIG. 1.

With reference to FIGS. 1 and 2, the reference numeral 1 indicates a mechanically operated diaphragm pump comprising a lower casing 2 inside which slides a rod 3 controlled by a rocker arm 4 pivoted by a pin 5 to the lower part of the casing 2. One arm of the rocker arm 4 comprises a fork 6 which cooperates with a head 7 of the rod 3 so as to displace the rod 3 downwards when the rocker arm 4 is rotated anti-clockwise by known operating means not shown, on overcoming the resilient reaction of a spiral spring 8. To the top end of the rod 3 there is fixed a pair of discs 11 between which a circular elastic diaphragm 12 is gripped. The perimetral part of the diaphragm 12 is gripped between an upper annular rim 13 of the casing 1 and an outer annular rim 14 of an intermediate casing 15. At its centre the casing 15 lowerly comprises a cavity 16 in which the upper end of the rod 3 can move. This rod is guided in its movement by a bush 17 fixed towards the lower part of the casing 2. About the rod 3 there is disposed a cylindrical gasket 18 with an outer annular base 21 to form a support for a spring 22 which rests at its other end against the lower of the discs 11.

The intermediate casing 15, which constitutes the support element for the pump suction and discharge valves, and is in the form of a cap, comprises upperly an annular wall 23 coaxial with a bore in the casing 15, into this bore there being fixed a ring 24. The bore in the ring 24 may be obstructed by a cap 25 on which acts a spring 26 which rests at its other end against an arm 27 extending inwards from the top of the annular wall 23. The intermediate casing 15 also comprises upperly a further annular wall 31 coaxial with a second bore in the casing 15. A ring 32 is fixed in the upper region of the annular wall 31. The bore in the ring 32 may be obstructed by a cap 33 on which acts a spring 34, the other end of which acts against an arm 35 extending inwards in the second bore coaxial with the annular wall 31. The ring 32 and cap 33 constitute the pump suction valve, whereas the ring 24 and cap 25 constitute the delivery valve. In the upper region of the intermediate casing 15 there extends an annular wall 37 which defines a chamber 38 housing the shut-off valve constructed in accordance with the present invention. In the chamber 38 there is disposed an element 41 of inverted cup form, constituting the closure seat for the shut-off valve, and comprises an outer annular gasket 42 and is fixed against an inner annular shoulder 43 at the lower end of the annular wall 37. The element 41 comprises an axial bore 44 and three radial fins 45 disposed at 120° to each other, and of greater height than the element 41. The top of the chamber 38 is closed by a metal cover 46, the edge of which is held in an annular seat provided in the upper edge of the annular wall 37. In this annular seat in the wall 37 there is also held the edge of an elastic diaphragm 47, and an annular seal gasket 48 is also disposed therein. A hole 49 is also provided in the cover 46. The top of a rod 51 is inserted into the centre of the elastic diaphragm 47, to its top end there being fixed a cap 52, while a further cap 53 is disposed on the opposite side of the diaphragm 47 which is thus gripped between the two said caps 52 and 53. The rod 51 is disposed through the axial bore 44 in the element 41, and lowerly comprises a flat head 54. On the lower part of the rod 51, above the head 54, there is mounted an axially bored sphere 55, conveniently constructed of a material which does not become damaged or altered on contact with the fuel. It may for example be constructed of rubber which resists up to 200° C. (VITON). At its bottom, the sphere 55 is arranged to close the shut-off valve by obstructing the axial bore 44 in the element 41. The chamber 38 is thus in communication via the bore 44 with the suction chamber 56 of the pump, in which the annular wall 31 is contained. The chamber 56 is defined by an annular wall 57 extending from the intermediate casing 15 and connected upperly to the annular wall 37.

An upper cover 58, conveniently of steel plate, is disposed on the intermediate casing 15 to form the pump delivery chamber 59 containing the annular wall 23. The upper cover 58 comprises an upper annular rim 61 disposed against an upper edge of the annular wall 57 to compress an annular gasket 62 therebetween, and also comprises a lower annular rim 63 which is folded against the upper annular rim 13 of the casing 1, and presses against the edge of the elastic diaphragm 12, the outer annular rim 14 of the intermediate casing 15 and an annular gasket 64. A duct 66 is screwed into the annular wall 37 for feeding the fuel from an outlet duct of a tank (not shown) to the chamber 38. As can be seen in FIG. 2, a perforated nut 67 and a tube 68 are fixed to the cover 58 and communicate with the delivery chamber 59, serving to feed the fuel respectively to the carburettor (not shown) and to the tank to form a recycle circuit.

The operation of the pump with the shut-off valve according to the present invention is as follows.

During normal operation, the movement of the rocker arm 4 induces reciprocating movement of the rod 3 and diaphragm 12. During the downward movement of the diaphragm 12, the spring 34 is compressed because of the suction created, and as the cap 33 moves downwards the suction valve opens, whereas as the cap 25 is thrust against the ring 24, the delivery valve remains closed. In contrast, during the upward movement of the diaphragm 12, the spring 26 is compressed because of the pressure created, so that the cap 25 is raised and the suction valve opens, whereas the cap 33 is thrust against the ring 32 and the suction valve closes.

Because of the suction created in the suction chamber 56 and the weight of the rod 51 of the shut-off valve, during normal operation the shut-off valve is open and has the configuration shown in FIG. 1, with the radial fins 45 constituting a stop for the cap 53. In this manner, the fuel arriving from the tank through the duct 66 reaches the chamber 38, passes through the axial bore 44 and reaches the suction chamber 56, and is then fed by the movement of the diaphragm 12 to the delivery chamber 59.

If the vehicle should overturn, as the pump is generally disposed at a higher level than the tank, it may finish up at a level lower than the tank with the inlet duct 66, previously at a higher level than the outlet duct of the tank, becoming located at a level of opposite sign, but there is no dangerous outflow of fuel as the pressure exerted by the fuel in the chamber 38 causes the elastic diaphragm 47 to move together with the rod 51, so that the sphere 55 closes the bore 44 and the shut-off valve thus remains closed. The hole 49 in the cover 46 allows the elastic diaphragm 47 to move freely.

If the pump inlet duct 66 is disposed at a lower level than the outlet duct of the fuel tank, then there is obviously no outflow of fuel on overturning because the duct 66 would then be at a higher level. In this arrangement, the shut-off valve according to the invention could serve as a closure valve should the pump operation cease.

With the shut-off valve according to the present invention, which is relatively simple, of reliable operation and economical, the serious dangers associated with the outflow of fuel from the feed pump of a motor vehicle following overturning are obviated.

Finally, modifications and variations may be made to the pump according to the present invention without leaving the scope of the inventive idea.

What we claim is:

1. A fuel pump for feeding fuel to an endothermic engine, comprising:

housing means;

a first displaceable sealing member secured to the housing means and defining therewith a pumping chamber, the housing means defining an inlet passage for passing fuel from a tank into said pumping chamber and an outlet for passing fuel from said pumping chamber to the engine;

drive means operatively connected to displace the first sealing member thereby alternately to increase and decrease the volume of the pumping chamber;

a suction valve disposed to admit fuel to the pumping chamber from the inlet passage when the first sealing member is displaced to increase the volume of the pumping chamber and to prevent fuel from leaving the pumping chamber by way of the inlet passage when the first sealing member is displaced to decrease the volume of the pumping chamber;

a discharge valve disposed to permit fuel to leave the pumping chamber by way of the outlet when the first sealing member is displaced to decrease the volume of the pumping chamber and to prevent fuel from entering the pumping chamber from the outlet when the first sealing member is displaced to increase the volume of the pumping chamber; and a shut-off valve which is independent of the suction valve and the discharge valve and is disposed within the housing at a position upstream, with respect to the direction of flow of fuel through the pump, of the suction valve, the shut-off valve comprising a second sealing member which is subject at one side to atmospheric pressure and at its other side to the pressure of fuel upstream of the suction valve and is displaceable between an outer position and an inner position, and a valve member which is connected to the second sealing member and is disposed in a normal position, in which it permits fuel to flow along the inlet passage to the pumping chamber, when the second sealing member is in said inner position, and is disposed in a shut-off position, in which it substantially prevents such flow, when the second sealing member is in said outer position, the second sealing member remaining in its inner position owing to the weight of the valve member when the pressure of fuel acting on said other side of the second sealing member is less than atmospheric and the force acting on the valve member owing to the pressure difference across the second sealing member is directed downwardly, and the second sealing member being displaced to its outer position when the pump is inverted and the pressure of fuel acting on said other side of the second sealing member exceeds a predetermined limit.

2. A fuel pump as claimed in claim 1, wherein said first displaceable sealing member comprises a first flexible diaphragm and said second sealing member comprises a second flexible diaphragm which, in use, is disposed substantially horizontally, said one side of the second diaphragm being above said other side thereof, and wherein said valve member comprises a rod secured to the second flexible diaphragm and, in use, depending downwardly therefrom within said inlet passage, and a sealing element carried by the rod and arranged to engage an inlet seal defined within said inlet passage when the second flexible diaphragm is in its outer position.

3. A fuel pump as claimed in claim 1, comprising a seat member positioned within said inlet passage and defining said inlet seat and bounding a circular constriction in the inlet passage, the rod extending in use downwardly from the second diaphragm through said circular opening with the valve element being positioned below said constriction.

4. A fuel pump as claimed in claim 1, wherein said housing means include an annular wall defining an inlet chamber which is part of said inlet passage and is closed at its upstream end by said second flexible diaphragm, and wherein the pump further comprises an annular seat member positioned within said inlet chamber and defining a central opening through which the rod extends, said sealing element having a substantially spherical external surface and being positioned downstream of said seat member, said seat member defining said inlet seat.

5. A pump as claimed in claim 4, comprising stop means for restricting movement of said rod in the direction of flow of fuel.

6. A pump as claimed in claim 5, wherein said stop means comprise three fins provided on said seat member.

* * * * *